US005772128A

United States Patent [19]

McRae

[11] Patent Number: 5,772,128

[45] Date of Patent: Jun. 30, 1998

[54] SYSTEM FOR ACOUSTICALLY DETECTING AND/OR REMOVING JAMS OF FLOWABLE MATERIAL IN A CHUTE, AND AIR HAMMER FOR PERFORMING THE REMOVAL

[75] Inventor: David J. McRae, Langhorne, Pa.

[73] Assignee: CSI Technology, Inc., Wilmington, Del.

[21] Appl. No.: 651,194

[22] Filed: May 17, 1996

[51] Int. Cl.[6] ..... B02C 25/00

[52] U.S. Cl. ..... 241/30; 241/36; 241/283

[58] Field of Search ..... 241/34, 36, 30, 241/283, 33; 367/908; 73/308

[56] References Cited

U.S. PATENT DOCUMENTS

| | | | |
|---|---|---|---|
| 3,020,720 | 2/1962 | Spalding . | |
| 3,166,222 | 1/1965 | Schrader . | |
| 3,637,115 | 1/1972 | Holm . | |
| 3,704,651 | 12/1972 | Kupka . | |
| 4,129,388 | 12/1978 | McKee . | |
| 4,207,005 | 6/1980 | Stanfield . | |
| 4,256,014 | 3/1981 | Kröger . | |
| 4,448,262 | 5/1984 | Vincent . | |
| 4,448,332 | 5/1984 | Plummer, Jr. . | |
| 4,449,671 | 5/1984 | Martinez-Vera et al. | 241/283 |
| 4,605,172 | 8/1986 | Ahlert . | |
| 4,693,732 | 9/1987 | Blackford et al. . | |
| 4,818,115 | 4/1989 | Törnqvist . | |
| 4,821,215 | 4/1989 | Woodward . | |
| 4,991,685 | 2/1991 | Airhart . | |
| 4,992,998 | 2/1991 | Woodward . | |
| 5,095,809 | 3/1992 | Kröger . | |
| 5,104,048 | 4/1992 | Cecil et al. | 241/283 |
| 5,128,656 | 7/1992 | Watanabe . | |
| 5,148,405 | 9/1992 | Belchamber et al. . | |
| 5,150,334 | 9/1992 | Crosby . | |
| 5,150,613 | 9/1992 | Etheridge | 241/33 |
| 5,277,260 | 1/1994 | Ranck . | |

FOREIGN PATENT DOCUMENTS

| | | | |
|---|---|---|---|
| 881175 | 7/1949 | Germany | 241/283 |

OTHER PUBLICATIONS

Catalog No. 100 for McMaster–Carr Supply Company, New Brunswick, NJ, ©1994, Piston Vibrators, p. 1488.

*Primary Examiner*—Mark Rosenbaum
*Attorney, Agent, or Firm*—Luedeka, Neely & Graham, P.C.

[57] ABSTRACT

A method for detecting the presence of and removing jams in a chute used for transporting a flowable material includes a jam breaking device which travels within the chute. An acoustic detector detects acoustic signals associated with movement of the material through the chute and compares the acoustic signal to a stored acoustic signature representative of an unjammed chute. If a jam is detected, the jam breaking device is operated for a fixed period of time to attempt to break up the jam. After another fixed period of time, a new acoustic signal is detected and processed to determine whether the jam is still present. If so, the jam breaking device is moved a predetermined distance along the chute and operated again. These steps are repeated as long as each new acoustic signal indicates that the jam is still present. The jam breaking device is an air hammer which includes a fluid inlet, at least one fixed block of mass in the housing, a piston powered by fluid from the fluid inlet and a plurality of fluid outlet ports circumferentially spaced around the housing for expelling a stream of high pressure fluid compressed by the piston. The piston reciprocates within the housing, repeatedly striking the fixed block of mass and causing the air hammer to vibrate. The vibration and stream of air operates to pulverize material near the air hammer.

26 Claims, 12 Drawing Sheets

100
216
188
256
258
190
192
196
218
168
220
165
164
210
178
222
176
152
224
144
160
246
226
252
124
248
306
246
238
148
166
180
228
202
198
140
156
130
134
206
128

242
240
246
248
244
304
226
236
252
226
144
148
306
238
238

SYSTEM FOR ACOUSTICALLY DETECTING AND/OR REMOVING JAMS OF FLOWABLE MATERIAL IN A CHUTE, AND AIR HAMMER FOR PERFORMING THE REMOVAL

FIELD OF THE INVENTION

The present invention relates generally to methods and apparatus for acoustically monitoring flow of materials through a chute to detect the formation of jams therein. The present invention also relates to methods and apparatus for removing the jams, and more particularly to an air hammer for removing the jams.

BACKGROUND OF THE INVENTION

Coal fired furnaces burn milled or pulverized coal. To deliver coal to a mill or pulverizer, the coal is dumped into a hopper and is gravity-fed into a coal chute at the end of the hopper. A feeder motor at the chute exit feeds the coal into the mill or pulverizer. occasionally, the flow of coal through the chute is interrupted by a coal jam in the chute. Coal jams are caused by numerous factors. Coal is often bunkered (i.e., stored) outside and may pick up moisture from rain or snow. Moisture in the coal may cause coal chunks to clump together and jam the chute. If the furnace is shut down for a period of time, the stored coal may settle in the bunkers and become compacted. Coal of fine particles is particularly susceptible to compaction. The compacted coal may then jam the chute when the furnace is restarted and the settled coal is fed into the hopper.

The interruption of coal flow to the mill or pulverizer can lead to a furnace outage, very large load swings and rapid thermal transients in the furnace. These problems are expensive to fix and are potentially damaging to equipment.

Prior art methods for detecting a no-flow condition in the hopper include monitoring feeder motor performance (% stroke and speed), exhauster or mill outlet temperature, and mill or pulverizer motor current. All of the prior art methods sense the secondary effects of a no-flow condition, but do not directly sense the stoppage of coal flow in the chute.

Accordingly, there is still a need for a system which does not rely on secondary indications of a jam, and which directly detects jams in a chute. The present invention fills this need by providing a system for acoustically monitoring the noise in the coal chute, comparing the noise signal to a prestored signal and determining whether the noise signal indicates the presence of a jam.

There is also a need to rapidly unclog detected jams without having to shut down the furnace and remove the jam. The present invention fills this need by providing an air hammer which travels along the length of the chute and breaks up jams.

SUMMARY OF THE INVENTION

The present invention in a first embodiment is a method for detecting the presence of and removing jams in a chute used for transporting a flowable material. The chute has an entrance for receiving a flow of the material and an exit. The chute includes a jam breaking device located therein for breaking up material jams which occur in the chute. The jam breaking device is initially located near the chute exit. The chute also includes an acoustic detector for detecting acoustic signals associated with movement of the material through the chute. The acoustic signal is periodically processed to determine whether material is flowing through the chute or whether material is not flowing through the chute due to a jam in the chute. If a jam is detected, the jam breaking device is operated for a fixed period of time to attempt to break up the jam. After another fixed period of time, a new acoustic signal is detected and processed to determine whether the jam is still present. If so, the jam breaking device is moved a predetermined distance toward the chute entrance. These steps are repeated as long as each new acoustic signal indicates that the jam is still present.

In another embodiment of the invention, the detected acoustic signal is compared to a stored acoustic signature to determine whether a jam is or is not present.

In yet another embodiment of the invention, the jam breaking device is an air hammer defined by a generally elongated and cylindrical housing. The air hammer comprises a fluid inlet, at least one fixed block of mass in the housing, a piston powered by fluid from the fluid inlet and a plurality of fluid outlet ports circumferentially spaced around the housing for expelling a stream of high pressure fluid compressed by the piston. The piston reciprocates within the housing, repeatedly striking the fixed block of mass and causing the air hammer to vibrate. The vibration and stream of air operates to pulverize material near the air hammer.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

Figure 1:
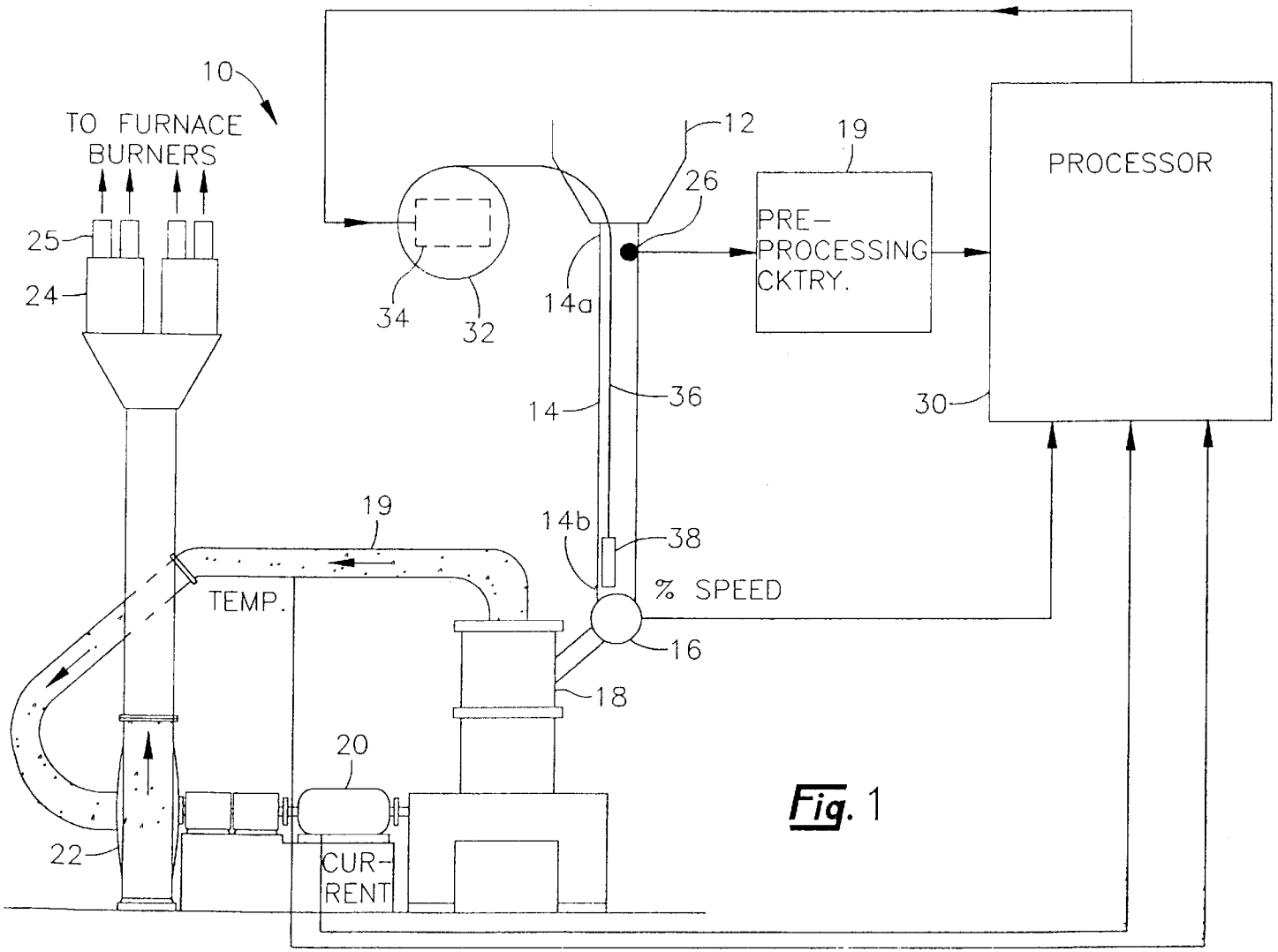
FIG. 1 is a diagrammatic view of one plant environment suitable for using the present invention.

Certain terminology is used herein for convenience only and is not be taken as a limitation on the present invention. In the drawings, the same reference numerals are used for designating the same elements throughout the several figures. The words "upper" and "lower" designate directions in the drawings to which reference is made.

FIG. 1 shows a portion of a coal furnace plant 10 which uses the present invention. The coal plant 10 includes a hopper 12, feed chute 14 having an entrance 14*a* and an exit 14*b*, feeder motor 16, coal mill or pulverizer 18, pulverizer outlet 19, pulverizer motor 20, exhauster 22, primary diffuser 24 and secondary diffuser 25. (The pulverizer outlet 19 is the suction side of the exhauster 22.) The elements 12–25 are all of conventional design and thus not described further. In an actual plant 10, a plurality of hoppers 12 and chutes 14 feed coal into a respective plurality of pulverizers 18. The outputs of the plurality of pulverizers 18 are fed into a single exhauster 22. For example, a 300 megawatt (MW) coal furnace may have sixteen sets of hoppers and chutes, feeding into three or more pulverizers. For simplicity, however, the present invention is described with a single hopper/chute/pulverizer configuration.

In use, coal is dumped by a coal transporter (not shown) into the hopper 12 and gravity-fed into the chute entrance 14*a*. The coal free falls through the chute 14 from the entrance 14*a* to the exit 14*b*. At the exit 14*b*, the coal is delivered by the feeder motor 16 into the pulverizer 18. From the pulverizer 18, the pulverized coal is fed to the exhauster 22 for delivery to the furnace burners (not shown).

The present invention, in its most basic form, includes the addition of jam detecting and jam removing elements to the coal plant 10. The jam detecting elements acoustically monitor noise in the chute 14. The jam removing elements provide for the control of a vibratory, air powered instrument for breaking up jams in the chute 14. More specifically, the jam detecting elements include an acoustic detector or sensor 26, signal preprocessing circuitry 28 which receives the output of the acoustic sensor, and a processor 30 which receives the output of the preprocessing circuitry 28. The jam removing elements include a take-up reel 32, a take-up reel motor 34, a line 36 extending from the take-up reel 32, and a jam breaking device 38 secured to or tethered to the end of the line 36. In the preferred embodiment of the invention, the jam breaking device 38 is an air hammer. The length of the line 36 is such that when the line 36 is extended to its maximum length, the air hammer 38 is located near the chute exit 14*b*. The take-up reel motor 34 receives a first output control signal from the processor 30. The line 36 delivers air and power to the air hammer 38. The line 36 is preferably a hollow braided steel cable having an air supply hose therein. However, other types of lines which are appropriate to support the air hammer 38 and deliver a flow of pressurized or compressed air to the air hammer 38 may be used without departing from the scope of the present invention. During initial operation of the jam removing aspect of the present invention, the air hammer 38 is located near the chute exit 14*b*. The air hammer 38 simultaneously provides two independent types of mechanical action for breaking up jams when a flow of pressurized air is supplied to it. First, the air hammer 38 vibrates. Second, the air hammer 38 emits pulses of high pressure or compressed air from ports around its periphery. The mechanical details of the air hammer 38 are described in detail below with respect to FIGS. 6–15.

The preferred embodiment of the invention uses the dual-action air hammer 38. However, the scope of the invention, as it relates to the apparatus and method for detecting and removing jams, includes other types of jam breaking devices, as well as other types of air hammers which simultaneously provide vibration and high pressure air pulses. Other types of jam breaking devices may include an electrically driven device that vibrates and/or emits pulses of compressed air, or an electric device that rotates a weighted member to break up the jam. The scope of the invention, as it relates to the apparatus and method for detecting and removing jams, also includes other types of air hammers which provide only one or the other type of action (i.e., either vibration or high pressure air pulses). Thus, the term "air hammer," as it relates to the apparatus and method for detecting and removing jams includes instruments functionally equivalent to an air hammer, such as gun hammers, air cannons, vibrators, and the like.

The processor 30 optionally receives a feeder motor speed signal from the feeder motor 16, a pulverizer motor current signal from the pulverizer motor 20, and an exhauster or mill outlet temperature signal from the pulverizer outlet 19. (The sensors for such signals are not shown.) The processor 30 optionally uses one or more of these signals to sense the secondary effects of a no-flow condition in the chute 14 in a manner known in the prior art. The additional signal inputs to the processor 30 may provide either a back-up and/or redundancy check to the acoustic monitoring system of the present invention to ensure that a coal jam never goes completely undetected.

Figure 2:
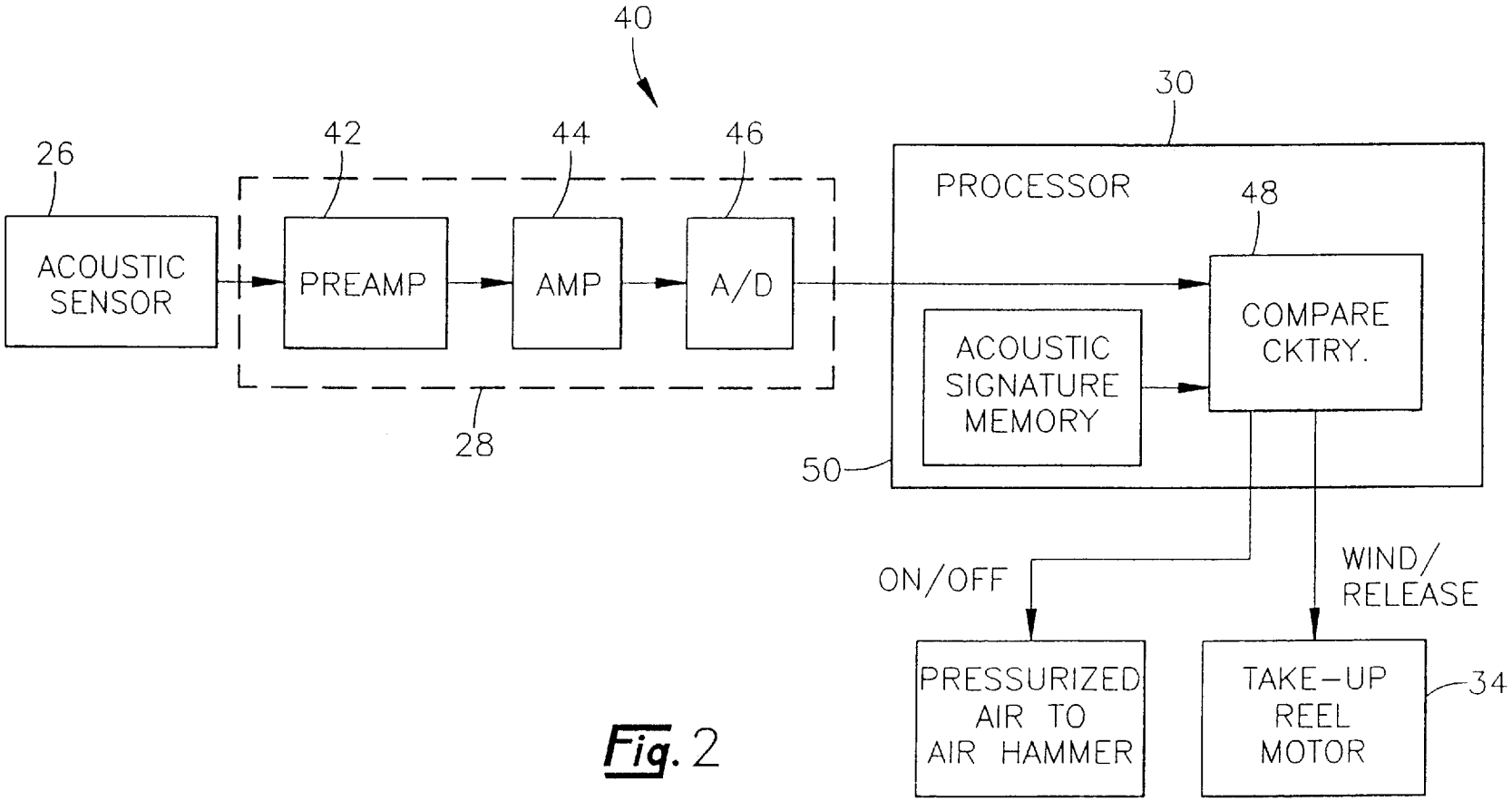
FIG. 2 is a schematic block diagram of a preferred embodiment of the present invention.

FIG. 2 shows a schematic block diagram 40 of a preferred embodiment of some electrical and mechanical elements of the present invention. The output signal of the acoustic sensor 26 is connected to the input of the preprocessing circuitry 28 which includes a signal preamplifier 42, a signal amplifier 44 and an A/D converter 46. The output of the preprocessing circuitry 28 is connected to a first input of the processor 30, specifically, to an input of compare circuitry 48 which forms part of the processor 30. The processor 30 also includes an acoustic signature memory 50 for storing acoustical data representative of the noise in a coal chute when coal is flowing freely therethrough and when coal is not flowing freely therethrough due to a jam. The output of the acoustic signature memory 50 is connected to a second input of the compare circuitry 48. The compare circuitry 48 compares the first signal received from the acoustic sensor 26 in the chute 14 with the second signal received from the acoustic signal memory 50.

The acoustic signature memory 50 may include amplitude data and/or frequency spectrum data. For example, the amplitude of an acoustic signal in the chute 14 when coal flows freely is significantly greater than the amplitude when there is a jam. Likewise, the frequency spectrum of an acoustic signal in the chute 14 when coal flows freely is significantly different than the frequency spectrum when there is a jam. From a signal processing standpoint, an amplitude analysis is simpler than a frequency spectrum analysis. For most purposes, an amplitude analysis is sufficient to detect jams. In one embodiment of the invention, a threshold amplitude value is set and provided to the compare circuitry 48. If the amplitude of the acoustic signal detected by the acoustic sensor 26 falls below the threshold value, the compare circuitry 48 determines that a jam is present. The threshold amplitude value effectively operates as an alarm threshold for acoustic monitoring system hardware.

The values stored in the acoustic signature memory 50 are determined by empirical data and may vary with the moisture content and fineness of the coal, the size of the chute, the size of the coal flowing through the chute, the flow rate of the coal, the location of the sensor 26, background noise from the feeder motor 16, feed rate of the feeder powered by the feeder motor 16, and other factors.

The acoustic signal which is detected by the acoustic sensor 26 is a result of the coal mixing with itself in the hopper 12 and chute 14, and the result of the coal moving downward and scraping against the walls of the hopper 12 and chute 14. Testing shows that the bulk of the detectable acoustic energy in the chute occurs in the 1 to 10 KHz range.

The functions of the signal preprocessing circuitry 28 and processor 30 may be implemented in hardware and/or software. Specific electrical components suitable for use as the acoustic sensor 26, signal preprocessing circuitry 28 and processor 30 are described below.

Figure 3A:
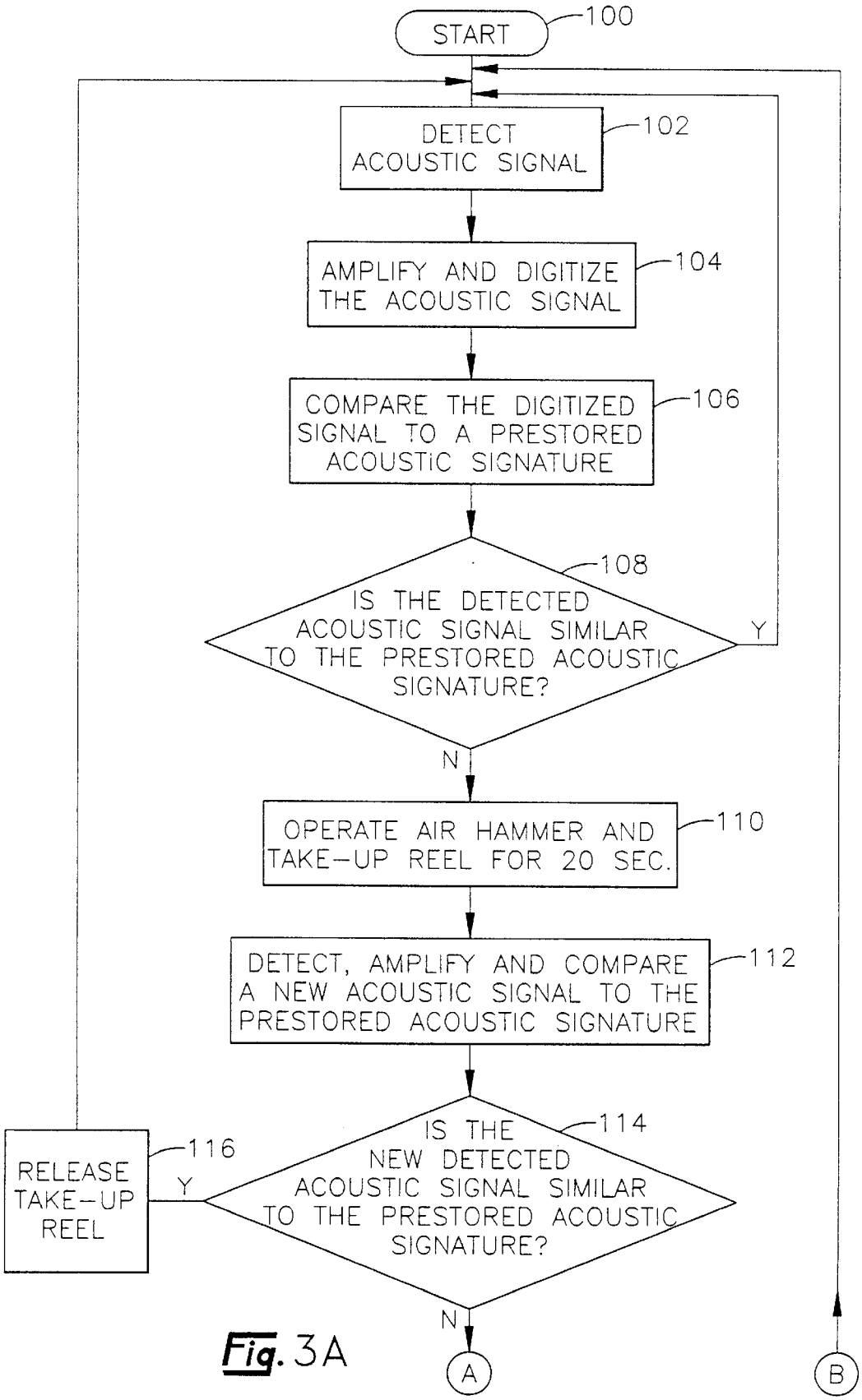
FIGS. 3A and 3B, taken together, are a flowchart of the operation of a preferred embodiment of the present invention, as performed by the parts of the schematic block diagram of FIG. 2.
Figure 3B:
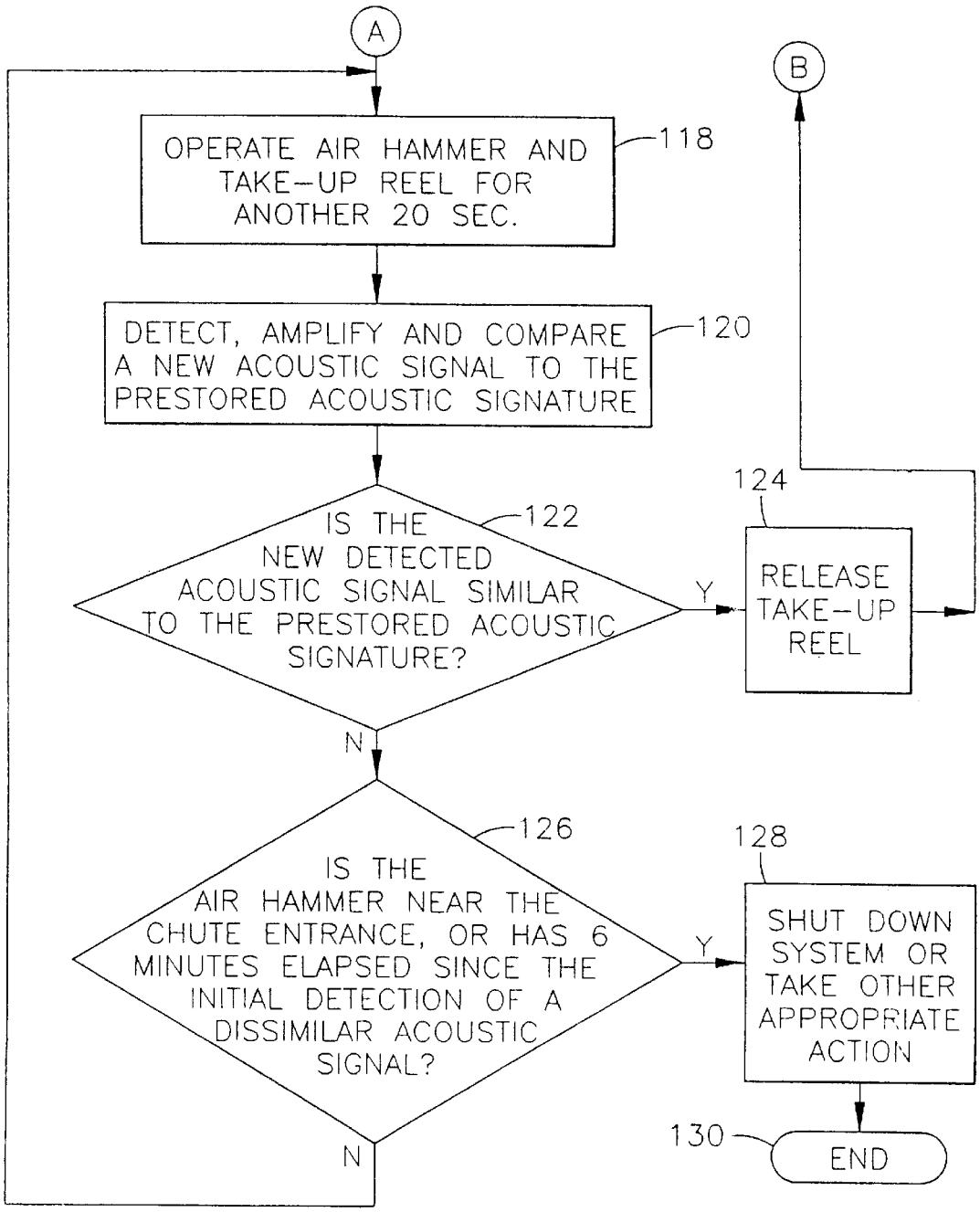

FIGS. 3A and 3B, taken together, are a flowchart of the operation of the acoustic monitoring and chute jam removal system 10 in accordance with one preferred embodiment of the invention. The flowchart is described in steps 100–130. For convenience, elements in FIGS. 1 and 2 are referenced as needed in the description below.

When it is desired to begin acoustic monitoring, the power is turned on to the acoustic sensor 26 (if it is an active element), the preprocessing circuitry 28 and the processor 30 (step 100). An acoustic signal is detected by the acoustic sensor 26 (step 102) and the signal is preprocessed, amplified and digitized by the preprocessing circuitry 28 (step 104). The digitized signal is sent to the compare circuitry 48 of the processor 30 and is compared to the data signal output from the acoustic signature memory 50 (step 106). If the digitized detected signal is similar to or within a predetermined range of the stored signal, the comparison indicates that the coal is flowing freely through the chute 14 and thus no jam is present (step 108), steps 102, 104 and 106 are thereafter continuously repeated at predetermined intervals for a new acoustic signal. If the digitized detected signal is not within the predetermined range of the stored signal, the comparison indicates that coal is not flowing freely through the chute and thus a jam is present. Accordingly, the processor 30 performs at least two control functions. First, the processor 30 outputs a first control signal to deliver pressurized air to the air hammer 38 for a first preset time period, such as 20 seconds (step 110). Second, the processor 30 outputs a second control signal to cause the take-up reel motor 34 to slowly wind up the line 36 around the take-up reel 32, thereby moving the air hammer 38 toward the chute entrance 14*a* (step 110). Preferably, the air hammer 38 is operated simultaneously with the movement of air hammer 38 toward the chute entrance 14*a*. However, in other embodiments of the invention, the movement may occur before or after the operation of the air hammer 38 or during only a portion of the first preset time period.

After the first preset time period has elapsed, a new acoustic signal is detected, amplified and compared in the processor 30 to the data signal output from the acoustic signature memory 50 (steps 112 and 114, which are identical to steps 106 and 108, respectively). There is a short waiting time between the end of the first preset time period and the collection of the new acoustic signal to allow echoes from the air hammer 38 to dissipate. A typical waiting time will be less than one second. If the new comparison indicates that the acoustic signal has returned to the expected value associated with free flowing coal, the probable explanation is that the jam was located near the chute exit 14*b* and the air hammer 38 successfully removed the jam. Accordingly, no further activation of the air hammer 38 is required and the air hammer 38 is returned to its initial location near the chute exit 14*b*. This step is performed by releasing the take-up reel 116 of the reel motor 34 (step 116). Upon release of the reel motor 34, the flow of the coal over and around the air hammer 38 causes the air hammer 38 to be pushed along with the coal flow, back toward the chute exit 14*b*. As described above, the line 36 only allows the air hammer 38 to reach near the chute exit 14*b* before it is maximally extended. After the take-up reel 32 is fully released, the flowchart returns to step 102.

If the new comparison in step 114 indicates that the jam is still present in the chute 14, the likely reason is that the jam is located further along the chute 14 toward the chute entrance 14*a*. Accordingly, the processor 30 again outputs a first and second control signal for another first preset time period to deliver pressurized air to the air hammer 38 and to cause the take-up reel motor 34 to move the air hammer 38 even further toward the chute entrance 14*a* (step 118). After the first preset time period has elapsed, and after another short waiting period, another new acoustic signal is detected, amplified and compared in the processor 30 to the data signal output from the acoustic signature memory 50 (steps 120 and 122). If the latest activation of the air hammer 38 cleared the jam, the take-up reel is released (step 124) and the flowchart returns to step 102. If the jam is still not cleared, the processor 30 checks to determine whether the air hammer 38 has been fully reeled and, thus, is near the chute entrance 14*a* (step 126). The processor 30 also checks to determine whether a second preset period of time has elapsed from the time that the jam was initially detected to the present time (step 126). If either of these conditions are present, the processor 30 signals to an operator to shut down the entire coal furnace system and terminate the jam removing process or take other appropriate action because the jam cannot be successfully cleared before the furnace runs out of a supply of coal (steps 128, 130). Instead of shutting down the furnace, the operator may be able to increase the flow of coal to the furnace from another hopper/pulverizer arrangement.

In one embodiment of the invention, the second preset period of time is set to be the amount of time until the supply of coal in the pulverizer 18 runs out. Once the second preset period of time is elapsed, the furnace will become starved for fuel and will begin to experience unwanted load swings and rapid thermal transients. However, if the jam is cleared before the pulverizer 18 runs out of coal, the new flow of coal will quickly make its way into the furnace, thereby avoiding the need to shut down the furnace.

A typical 300 MW coal furnace plant 10 may have sixteen sets of hoppers and chutes, feeding into three or more pulverizers. A typically sized pulverizer 18 used with a large coal furnace plant which initially operates at or near full capacity will run for about six minutes until the supply of coal therein runs out. Thus, in the example of the invention described herein, the second preset period of time is about six minutes.

If the jam is still not cleared, and the air hammer 38 has not been fully reeled and the second preset period of time has not elapsed, the processor 30 again outputs a first and second control signal for another first preset time period to deliver pressurized air to the air hammer 38 and to cause the take-up reel motor 34 to move the air hammer 38 even further toward the chute entrance 14*a* (step 118). The steps 118, 120 and 122 are continually repeated until the jam is cleared, or until one of the conditions in step 126 occurs.

FIG. 1 shows a preferred diagrammatic view of the placement and arrangement of elements in the present invention. However, the scope of the invention includes any arrangement which can perform the necessary monitoring and jam removing functions. For example, FIG. 1 shows that the acoustic sensor 26 is preferably located near the chute entrance 14*a*. However, the acoustic sensor 26 may be placed in other locations near the chute 14, or along the interior of the chute 14. Furthermore, a plurality of acoustic sensors 26 may be used and their signals averaged or otherwise algebraically manipulated. FIG. 1 also shows that the air hammer 36 is preferably travels along a sidewall of the chute 14. Instead, the air hammer 36 may be suspended so that it traverses a center region of the chute 36. Instead of being tethered to the line 36, the air hammer 36 may travel along a track or the like which traverses the length of the chute 14.

The present invention may also be used to detect partial flow problems in chutes. Partial jams also cause detectable amplitude and frequency changes in the output of the acoustic sensor 26. The use of the word "jam" and "jams" throughout the description is meant to encompass either complete jams or partial jams.

The manner of operating the air hammer 36 during each of the first preset time periods may vary depending on the type and consistency of material flowing in the chute 14. A preferred manner of operation for the air hammer 36 described in the present invention is to set the first preset time period to 20 seconds and to cause 40 thumps (i.e., 20 piston cycles) during the 20 seconds.

The electrical elements shown in FIG. 2 may be selected from any suitable off-the-shelf parts. In one embodiment of the invention, the following parts are used:

- acoustic sensor 26 - Columbia Model 826 Accelerometer or equivalent low frequency accelerometer
- preamplifier 42 - T5 Model PRE-3 preamp, Triple 5 Industries, Trenton, N.J.
- amplifier 44, A/D converter 46 and processor 30 - T5 Acoustic Monitoring System (AMS) Processor with AF-1 Amplifier/Filter Module, Audio/Alarm Module and VM-2 Voltmeter Module The T5 AMS Processor interfaces with a plant computer, a strip-chart recorder, or the T5 DL-1 Data Logging Spectrum Analyzer. The T5 DL-1 stores trend plots for 60 days, frequency spectrums for 10 days, and has a bar graph display of sensor output levels. The T5 AMS Processor is set to an instrument range of 1–11 KHz to capture acoustic data in the 1–10 KHz range.

Figure 4:
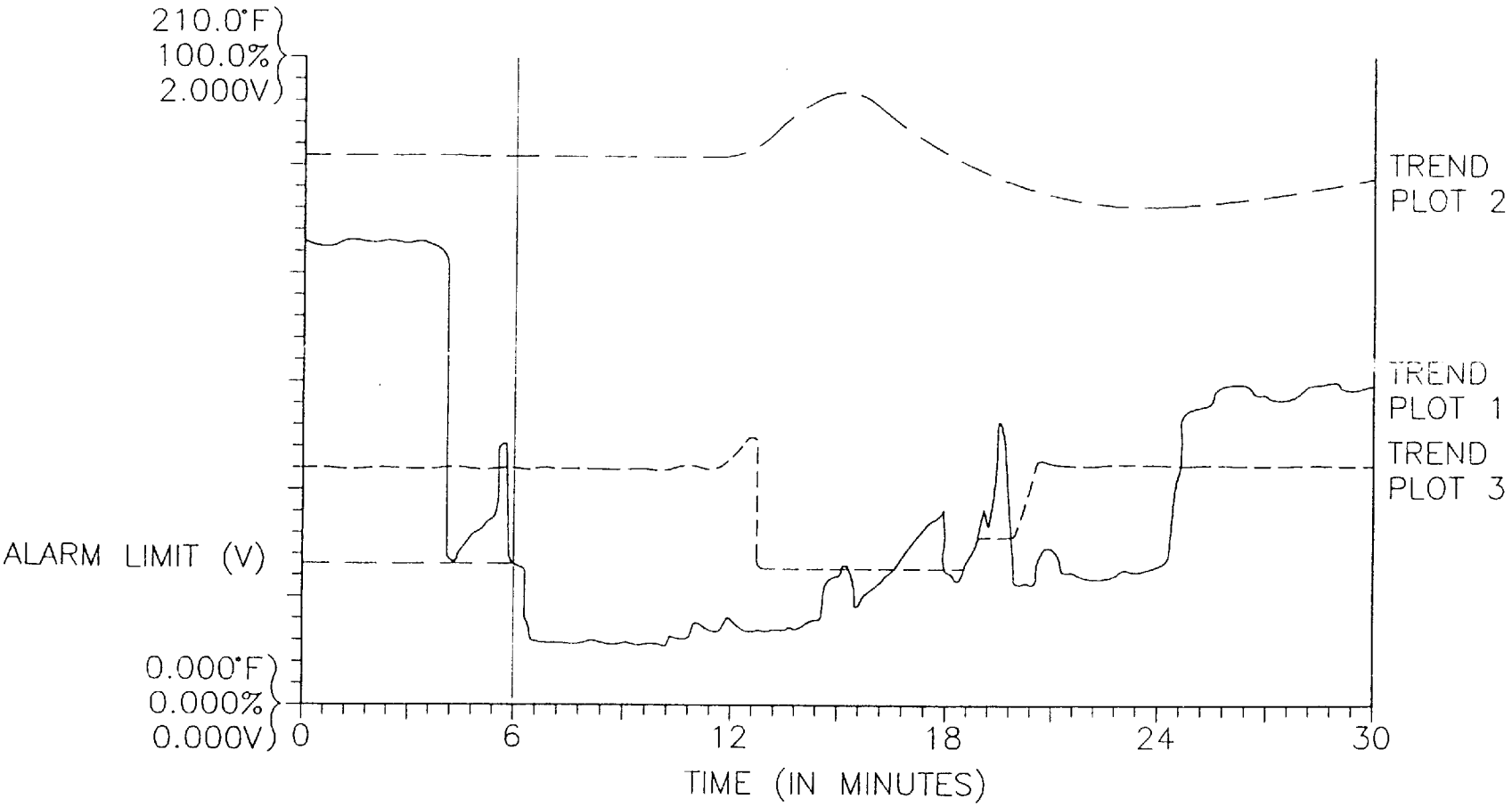
FIG. 4 is a trend graph of data collected from a plant using the present invention.

FIG. 4 illustrates one advantage of the present invention, namely early detection of a jam in a chute. FIG. 4 is trend plot data taken from an actual coal plant which simultaneously shows three different measured values plotted on a common time axis (x-axis) over about a 30 minute period. The beginning of the x-axis is labelled as zero minutes for convenience. It should be understood that FIG. 4 is merely a snapshot of 30 minutes of data. The y-axis is different for each trend plot. Trend plot 1, shown with a solid line, is a plot of the relative acoustic noise in a chute 14. The y-axis in the trend plot 1 goes from 0–2 volts RMS (V RMS) with an alarm limit set at about 0.5 V RMS. The V RMS are directly proportional to an acoustic noise amplitude value. Trend plot 2, shown with long dashed lines, is a plot of bowl temperature as measured from the pulverizer outlet 19. This temperature is proportional to the temperature in the pulverizer 18, and may be used as a representation thereof. The y-axis in the trend plot 2 goes from 0°–210° F. Trend plot 3, shown with short dashed lines, is a plot of the feeder speed of the feeder motor 16. The y-axis in the trend plot 3 goes from 0–100% of capacity.

The prior art secondary monitoring techniques described above, detected the jam in the chute 14. At about the 12 minute line, the bowl temperature started to rise at a significant rate. A partially empty or empty bowl will be hotter than a bowl which is filled near its capacity. Also, at about the 12 minute line, the capacity of the feeder motor 16 decreased significantly, as measured by its feeder speed. However, by using acoustic monitoring, the jam was detected at about the 6 minute line when the plot of acoustic noise reached the alarm limit. The acoustic monitoring feature gave the operator about another six minutes to take appropriate remedial action as a result of the jam. One remedial action is to attempt to remove the jam from the chute. The jam removing system described in the present invention can clear most jams in that time frame. Another remedial action is to increase the flow of coal into the furnace from another pulverizer.

Figure 5:
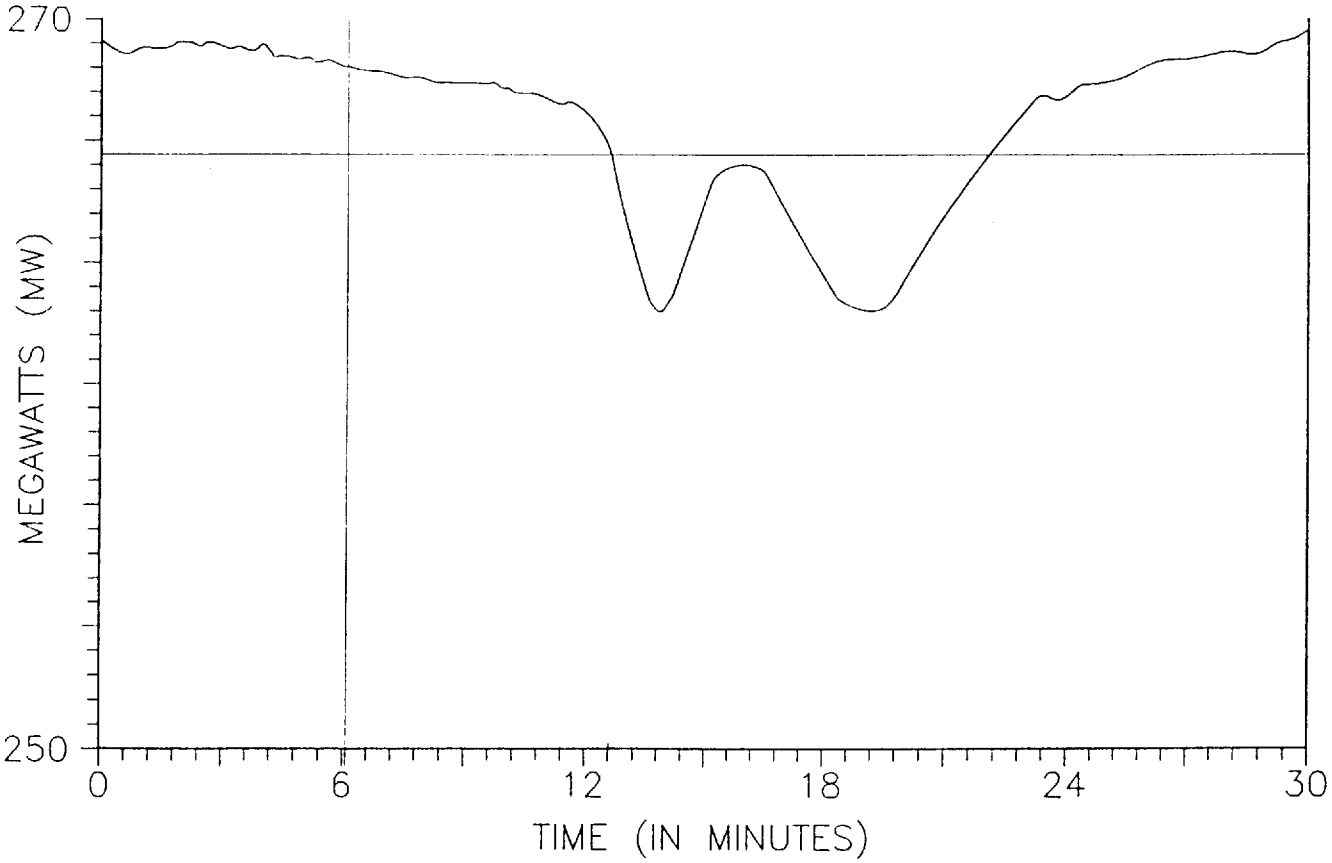
FIG. 5 is a trend graph of the power output of the plant during the time period shown in FIG. 4.

FIG. 5 shows the corresponding megawatt swing caused by the jam associated with FIG. 4. The coal plant was outputting about 269 MW at zero minutes, before the jam developed. After about six minutes, the output dropped slightly to about 268 MW. Such a slight drop could be the result of numerous transient events and would probably be ignored by an operator. It would certainly not be interpreted by an operator as necessarily indicating that there is a jam in a chute leading to a pulverizer. After about twelve minutes, the output dropped to about 265 MW. At this point, an alarm will have signalled that there is a problem in the plant. The operator, upon further investigation, may discover that the problem is due to a jam in a chute. Since there is a lag time before remedial action can be taken, the output wattage dropped further, reaching as low as about 260 MW. This large load swing is highly undesirable.

The present invention would have detected the jam at about the six minute mark. Accordingly, significantly more time would have been available to take remedial action before any significant load swing occurs.

Although the present invention is described in the environment of a coal plant, the invention may be used with any form of a conduit for conveying free-flowing materials, wherein solids are part of the material. Such materials include flows of solid particles, slurries and the like. Also, the scope of the invention is not limited to use with chutes or conduits which gravity feed materials. For example, the chute could move the materials by pressure or by other types of forces.

As described above, a jam breaking device suitable for use in removing jams is an air hammer which travels along the length of the chute and breaks up the jams by vibration and pulses of pressurized air.

One suitable type of air hammer 38 is a reciprocating piston vibrator having circumferentially spaced pressurized fluid exit ports, and operated at low speed. Piston vibrators are typically mounted to a fixed surface or object for vibrating the surface or object and typically operate at speeds greater than 1,000 vibrations per minute (VPM). (Each strike of the piston against a strike surface causes one vibration.) Experimentation with such vibrators in coal hoppers showed that high speed piston vibrators merely compact the coal, and thus, are unsuitable for breaking up coal jams. In contrast, a piston vibrator operated at a slow speed, as described below, is particularly suitable for breaking up coal jams. The piston vibrator used herein preferably operates at speeds significantly below 1,000 VPM and is most effective at breaking up coal jams when operated at speeds from about 60 to about 300 VPM. In one preferred embodiment of the invention, the piston vibrator used herein operates at a speed of about 120 VPMs, or 60 piston cycles per minute.

Figure 6:
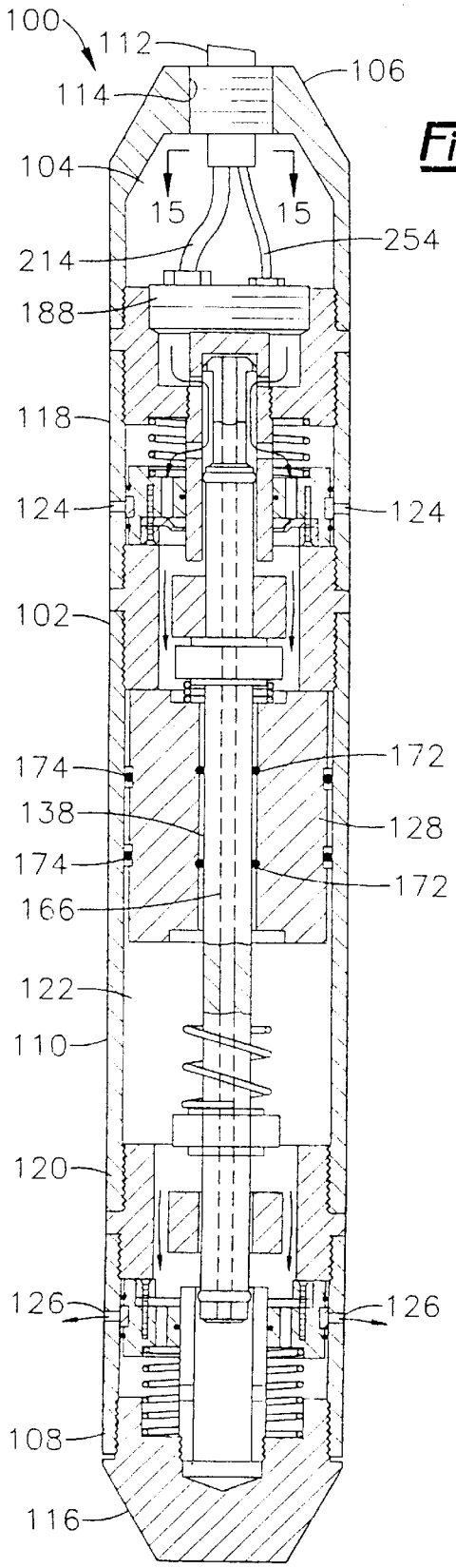
FIGS. 6 and 7 are longitudinal sectional views of a piston vibrator suitable for use as an air hammer in the present invention.
Figure 7:
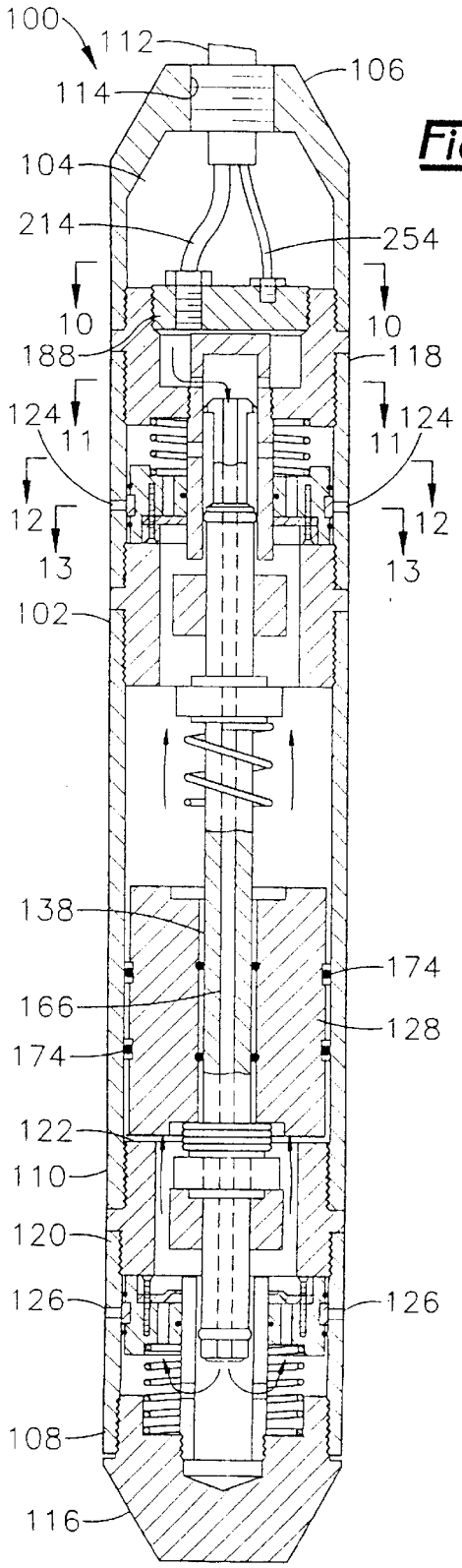
Figure 8:
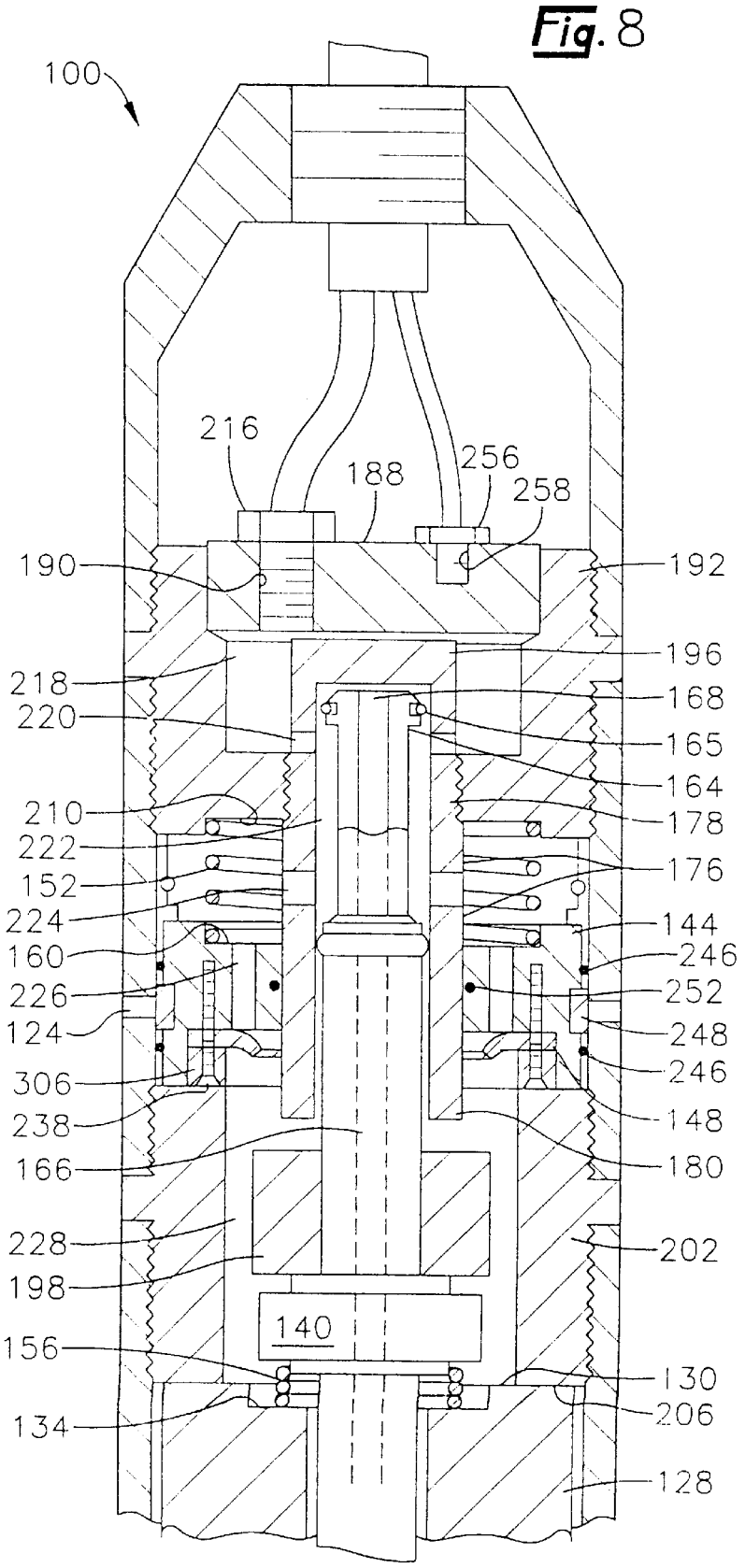
FIG. 8 is an enlarged, fragmentary, longitudinal sectional view of an upper portion of the piston vibrator.
Figure 9:
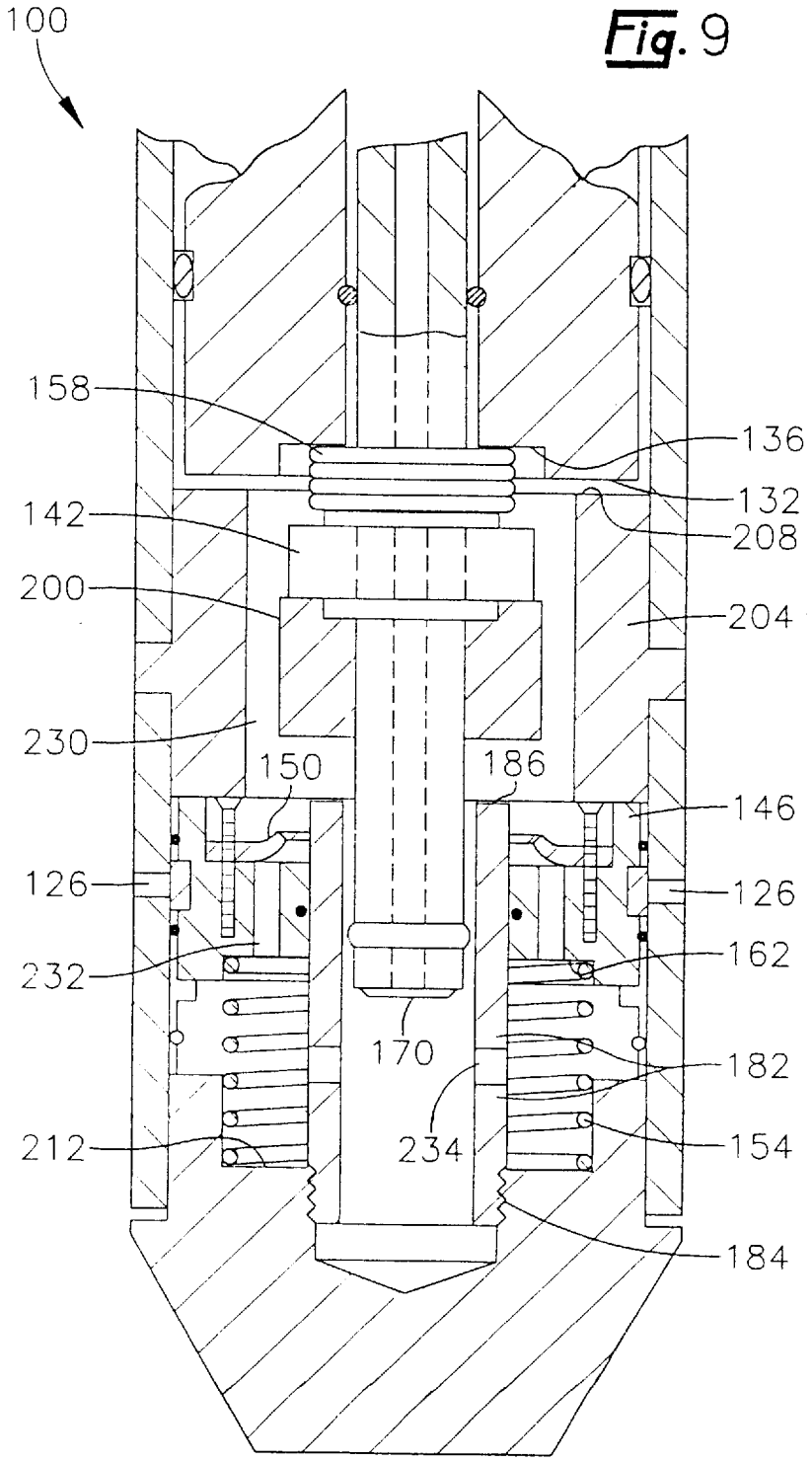
FIG. 9 is an enlarged, fragmentary, longitudinal sectional view of a lower portion of the piston vibrator.

FIGS. 6–12 show a preferred embodiment of a piston vibrator 100. FIG. 6 is a longitudinal sectional view of the piston vibrator 100 showing the piston immediately before the downstroke. FIG. 7 is a longitudinal sectional view of the piston vibrator 100 showing the piston immediately before the upstroke. FIG. 8 is an enlarged, fragmentary, longitudinal sectional view of an upper portion of the piston vibrator 100. FIG. 9 is an enlarged, fragmentary, longitudinal sectional view of a lower portion of the piston vibrator 100. FIGS. 10, 11, 12 and 13 are transverse sectional views taken along lines 10—10, 11—11, 12—12 and 13—13, respectively, of FIG. 7. FIG. 14 is an exploded view of a check valve in the piston vibrator 100. For clarity, the parts and operation of the piston vibrator 100 are described with respect to FIGS. 6–9.

The piston vibrator 100 is defined by an elongate, bullet-shaped hollow housing 102 defining a cylindrical bore 104. The hollow housing 102 has an upper end 106, an open lower end 108 and a circumferential surface 110 therebetween. A hollow cable 112, such as a PVC-coated hollow braided steel cable, extends through a hole 114 in the upper end 106. (The cable 112 is equivalent to the line 36 shown in FIG. 1.) The cable 112 is secured to the upper end 106. The lower end 108 is closed off by an end cap 116. The housing 102 is also generally defined by an upper portion 118 and lower portion 120. The housing 120 also defines a generally central chamber 122. The upper portion 118 has a plurality of radial upper coaxial passages or upper side ports 124 which are circumferentially spaced around, and extend through, the housing 102. The lower portion 120 includes an identical set of lower side ports 126. The upper and lower side ports 124 and 126 provide an exit for pressurized fluid flowing through the housing 102.

The hollow housing 102 contains all of the moving parts of the piston vibrator 100, including a reciprocating piston 128 having an upper surface 130, lower surface 132, upper inner groove 134 and lower inner groove 136; a hollow reciprocating valve stem 138 having upper and lower collars 140 and 142 fixed thereto; upper and lower check valves 144 and 146 having flexible seals 148 and 150; upper and lower biasing springs 152 and 154; upper and lower damping springs 156 and 158; and related gaskets, seals and the like. The upper check valve 144, upper biasing spring 152 and upper damping spring 156 are disposed generally in the upper portion 118 of the housing 102, whereas the lower check valve 146, lower biasing spring 154 and lower damping spring 158 are disposed generally in the lower portion 120 of the housing 102. The upper check valve 144 includes outer facing surface 160 for receiving one end of the upper biasing spring 152. Likewise, the lower check valve 146 includes outer facing surface 162 for receiving one end of the lower biasing spring 154. The hollow valve stem 138 includes a hollow valve stem head 164 at its upper end. An O-ring 165 is disposed in a groove along the outer circumference of the valve stem head 164. The hollow valve stem 138 defines a valve stem channel 166 having a first open end 168 and a second open end 170. The piston 128 is disposed in the central chamber 122. The piston's inner grooves 134 and 136 are sized to accept one end of the respective upper and lower damping springs 156 and 158. In operation, the springs 250 and 252 become sandwiched between the grooves 134 and 136, and respective upper and lower collars 140 and 142. Furthermore, the piston 128 includes a pair of inner and outer O-rings 172 and 174 seated in circumferential grooves of the piston. The outer O-rings 174 provide a tight seal between the outer circumference of the piston 128 and the inner circumferential surface of the housing 102. The inner O-rings 172 provide a tight seal between the inner circumference of the piston 128 and the outer circumference of the valve stem 138.

The hollow housing 102 also contains parts which are fixed to the circumferential surface of the housing 102, including upper valve body 176 having first and second portions 178 and 180; lower valve body 182 having first and second portions 184 and 186; cable/hose bracket 188 having fluid entry fitting 190 therethrough; mount 192; disk fitting 196; upper and lower valve stem stops 198 and 200; upper and lower anvils 202 and 204 having respective strike surfaces 206 and 208; and the end cap 116 (noted above). The mount 192 secures the cable/hose bracket 188 to the housing 102. The mount 192 also includes inner facing surface 210 for receiving the other end of the upper biasing spring 152, thus sandwiching the spring 224 between the mount 192 and the upper check valve 144. Likewise, the end cap 116 includes inner facing surface 212 for receiving the other end of the lower biasing spring 154, thus sandwiching the lower biasing spring 154 between the end cap 116 and the lower check valve 146. The upper valve body 176, cable/hose bracket 188, mount 192, disk fitting 196, upper valve stem stop 198 and upper anvil 202 are disposed generally in the upper portion 118 of the housing 102, whereas the lower valve body 182, lower valve stem stop 200 and lower anvil 204 are disposed generally in the lower portion 120 of the housing 102. The valve stem head 164 is seated within the disk fitting 196 when the valve stem 138 is in its first position.

In the embodiment of the invention described herein, the functionally similar parts of the piston vibrator 100 in the upper and lower portions 118 and 120 of the housing 102 are identical. However, the scope of the invention includes embodiments wherein functionally similar, but non-identical parts are used in the upper and lower portions 118 and 120.

In operation, the piston 128 reciprocates between, and slams against, the strike surfaces 206 and 208 of the respective upper and lower anvils 202 and 204. As the piston 128 reciprocates between its uppermost position (shown in FIG. 6) and its lowermost position (shown in FIG. 7), it causes two other movements of parts.

First, fluid which is ahead of the piston 128 and which thus becomes compressed in the housing 102, causes one of the check valves 144 or 146 to move from a first position to a second position. In the first position, the check valve 144 or 146 blocks fluid flow through the side ports 124 or 126. In the second position, the check valve 144 or 146 allows fluid flow through the side ports 124 or 126 (i.e., the check valve 144 or 146 allows fluid to be exhausted from the housing 102).

Second, the piston 128 contacts either the upper collar 140 or lower collar 142 of the valve stem 138 and causes travel of the valve stem 138 from a first position (shown in FIG. 6) to a second position (shown in FIG. 7). In the first position, the valve stem 138 causes the fluid flow through the housing 102 to take a first path through the housing. In the second position, the valve stem 138 causes the fluid flow through the housing 102 to take a second path through the housing. The first and second paths are described in more detail below.

As described above, when a constant source of pressurized fluid is supplied to the piston vibrator 100, the piston 128 continuously reciprocates and the valve stem 138 and check valves 144 and 146 continuously move between their first and second positions. This causes two effects which help to break up coal jams. First, vibrations of the piston vibrator 100 are transferred to the coal. Second, high pressure bursts of fluid exhausted through the side ports 124 or 126 shoot against the coal, further disturbing the jam.

The fluid flow paths are described next with respect to FIGS. 6 and 7. In both flow paths, fluid is delivered to the fitting 190 from a fluid supply hose or line 214 which is connected to a suitable source of pressurized fluid at a selectively controlled pressure. The fluid supply line terminates in a hollow fitting screw 216 which is mounted in the fitting 196. The fluid passes through the fitting 196 and into a cavity 218 defined by the mount 192. The fluid then flows through first passageway 286 defined between the fitting 196 and the first portion 178 of the upper valve body 176. Subsequently, the fluid flows through one of two different paths, depending upon the position of the valve stem 138, which is a function of the position of the piston 128. The fluid flow path when the valve stem 138 is in the first position is shown by solid arrows in FIG. 6. This position is associated with the piston downstroke. The fluid flow path when the valve stem 138 is in the second position is shown by solid arrows in FIG. 7. This position is associated with the piston upstroke.

Turning first to FIG. 6, the fluid flows, in turn, through (a) first longitudinal feed passage 222 defined between the outer circumferential wall of the valve stem 138 and the inner circumferential wall of the first portion 178 of the upper valve body 176, (b) second passageway 224 defined between the first portion 178 and second portion 180 of the upper valve body 176, (c) upper check valve 144 (through first longitudinal channel 226 defined in the upper check valve 144 and past the flexible seal 148 which is flapped open by the fluid pressure, as shown in FIG. 8), and into first longitudinal cavity 228 defined generally between the outer circumferential wall of the valve stem 138 and the inner circumferential wall of the upper anvil 202.

The lower portion 120 of the housing 102 includes fluid passages which are generally a mirror image of the passages in the upper portion 118. Thus, the lower portion 120 includes a second longitudinal cavity 230 defined generally between the outer circumferential wall of the valve stem 138 and the inner circumferential wall of the lower anvil 204, a second longitudinal channel 232 defined in the lower check valve 146, and a third passageway 234 defined between the first portion 184 and second portion 186 of the lower valve body 182.

Turning again to the operation of the vibrator 100, fluid pressure against the piston's upper surface 130 causes the piston 128 to move downward, slamming against the strike surface 208 of the lower anvil 204. Fluid disposed in the portion of the chamber 122 not taken up by the piston 128 flows into the second longitudinal cavity 230. The fluid from the chamber 122 and the fluid in the second longitudinal cavity 230 is pushed against the flexible seal 150 of the lower check valve 146, maintaining the flexible seal 150 in the closed position. When the fluid pressure against the seal 150 becomes sufficient to overcome the tension of the lower biasing spring 154, the lower check valve 146 moves downward into the second position, shown by phantom lines in FIG. 9. When the lower check valve 146 reaches the second position, the fluid formerly in the chamber 122 and the second longitudinal cavity 230 flows out of the housing 102 through the lower side ports 126 as a burst of fluid.

Referring again to FIG. 6, as the piston 128 approaches the lower anvil 204, the piston's lower inner groove 136 contacts the lower damping spring 158, which in turn, contacts the lower collar 142 of the valve stem 138 (the spring 252 becoming sandwiched between the groove 136 and the lower collar 142). Since the lower collar 142 is fixed to the valve stem 138, the piston 128 causes the valve stem 138 to be pushed downward to its second position, shown in FIG. 7.

Once the fluid in the chamber 122 and the second longitudinal cavity 230 is expelled, the lower biasing spring 154 returns the lower check valve 146 to its first position, thereby closing off the flow path through the side ports 126. The fluid flow path now changes to the path shown in FIG. 7.

Referring to FIG. 7, the valve stem 138 is shown in its second position. In this position, the first longitudinal feed passage 222 is blocked by the valve stem head 164. Accordingly, the fluid from the feed passage 222 flows into the valve stem's first open end 168, through the valve stem channel 166 and out the valve stem's second open end 170. The fluid then flows through the lower check valve 146 (through second longitudinal channel 236 defined in the lower check valve 146 and past the flexible seal 150 which is flapped open by the fluid pressure, as shown in FIG. 9), and into the second longitudinal cavity 230 defined generally between the outer circumferential wall of the valve stem 138 and the inner circumferential wall of the lower anvil 204.

Fluid pressure against the piston's lower surface 132 causes the piston 128 to move rapidly upward, slamming against the strike surface 206 of the upper anvil 202. Fluid disposed in the portion of the chamber 122 not taken up by the piston 128 flows into the first longitudinal cavity 230. The fluid from the chamber 122 and the fluid in the first longitudinal cavity 228 is pushed against the flexible seal 148 of the upper check valve 144, maintaining the flexible seal 148 in the closed position. When the fluid pressure against the seal 148 becomes sufficient to overcome the tension of the upper biasing spring 152, the upper check valve 144 moves upward into the second position, shown by phantom lines in FIG. 8. When the upper check valve 144 reaches the second position, the fluid formerly in the chamber 122 and the first longitudinal cavity 228 flows out of the housing 102 through the upper side ports 124 as a burst of fluid.

Referring again to FIG. 7, as the piston 128 approaches the upper anvil 202, the piston's upper inner groove 134 contacts the upper damping spring 156, which in turn, contacts the upper collar 140 of the valve stem 138 (the spring 250 becoming sandwiched between the groove 134 and the upper collar 140). Since the upper collar 140 is fixed to the valve stem 138, the piston 128 causes the valve stem 138 to be pushed upward to its first position.

Once the fluid in the chamber 122 and the first longitudinal cavity 228 is expelled, the upper biasing spring 152 returns the upper check valve 144 to its first position, thereby closing off the flow path through the upper side ports 124. The fluid flow path now changes to the path shown in FIG. 6. The piston vibrator 100 continuously repeats the cycle described above as long as a continuous source of pressure is applied through the fluid supply line 214.

FIG. 14 shows an exploded view of the upper check valve 144 of FIGS. 6–9 (the lower check valve 146 being of identical construction). The upper check valve 144 includes a valve body 236 having a circular cutout 304. Four longitudinal channels 226 extend through the valve body 236 and are opened and closed by the flexible seal 148 described above. The flexible seal 148 is mounted in the cutout 304 by a clamping or retaining ring 306 which fits into the cutout 304 by mounting screws 238. When fully assembled, the flexible seal 148 is thus sandwiched between the retaining ring 306 and the valve body 236. The flexible seal 148 may be constructed of rubber or a similar elastomeric material. There are three grooves in the outer circumference of the valve body 236, an upper groove 240, lower groove 242 and center groove 244 disposed therebetween. The center groove 244 has significantly more longitudinal width than the upper and lower grooves 240 and 242. O-rings 246 are retained in the upper and lower grooves 240 and 242 for maintaining a tight seal during use. A TEFLON seal 248 is disposed in the center groove 244 for preventing coal dust from entering the housing 102 during use. The valve body 236 also has an internal center groove 250 for retaining an internal O-ring 252.

The piston vibrator 100 may also be provided with a safety feature for retracting the vibrator 100 from a chute 14 if the cable 112 becomes damaged. Since the cable 112 is hollow, any damage to the outer sheath could potentially cause the cable 112 to break off, leaving the vibrator 100 stranded in a coal jam or allowing it to free-fall into the feeder motor 16. Accordingly, an optional back-up cable 254, such as a stainless steel cable, may be provided in the cable 112. The end of the cable 112 terminates in a fitting screw 256 which is mounted in the fitting 196 of the cable/hose bracket 188. The other end of the cable 112 is attached to a take-up reel (not shown).

Figure 12:
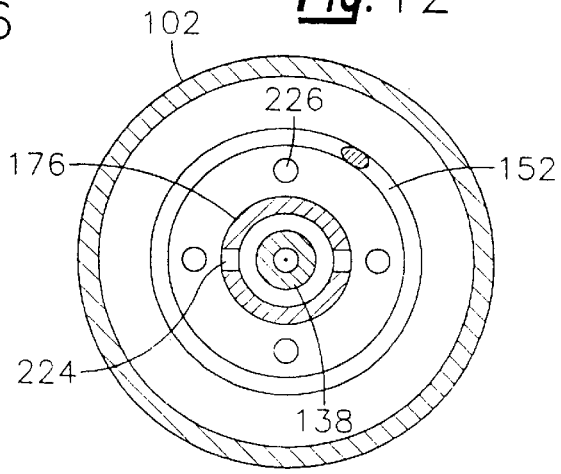
FIG. 12 is a transverse sectional view of the piston vibrator taken along line 12—12 of FIG. 7.
Figure 13:
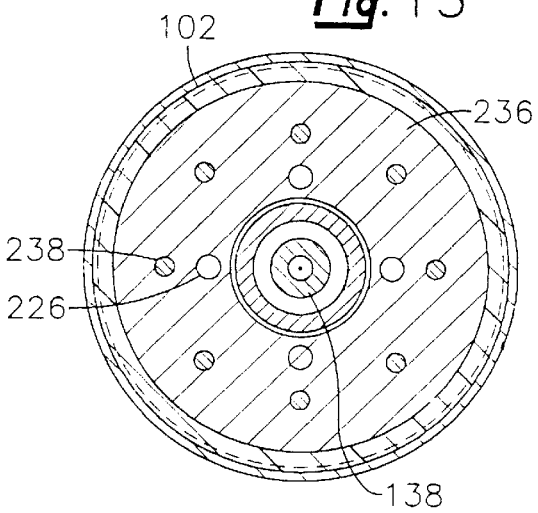
FIG. 13 is a transverse sectional view of the piston vibrator taken along line 13—13 of FIG. 7.
Figure 10:
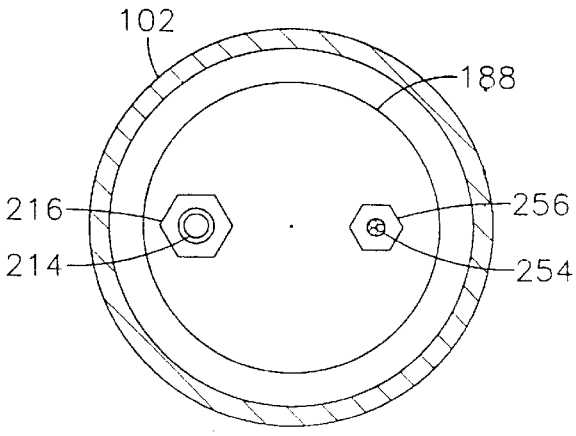
FIG. 10 is a transverse sectional view of the piston vibrator taken along line 10—10 of FIG. 7.
Figure 11:
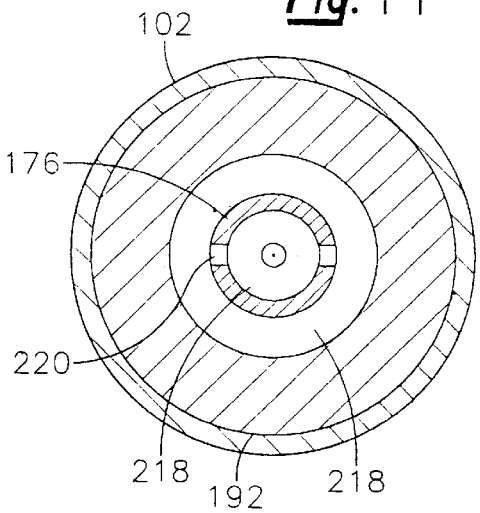
FIG. 11 is a transverse sectional view of the piston vibrator taken along line 11—11 of FIG. 7.
Figure 14:
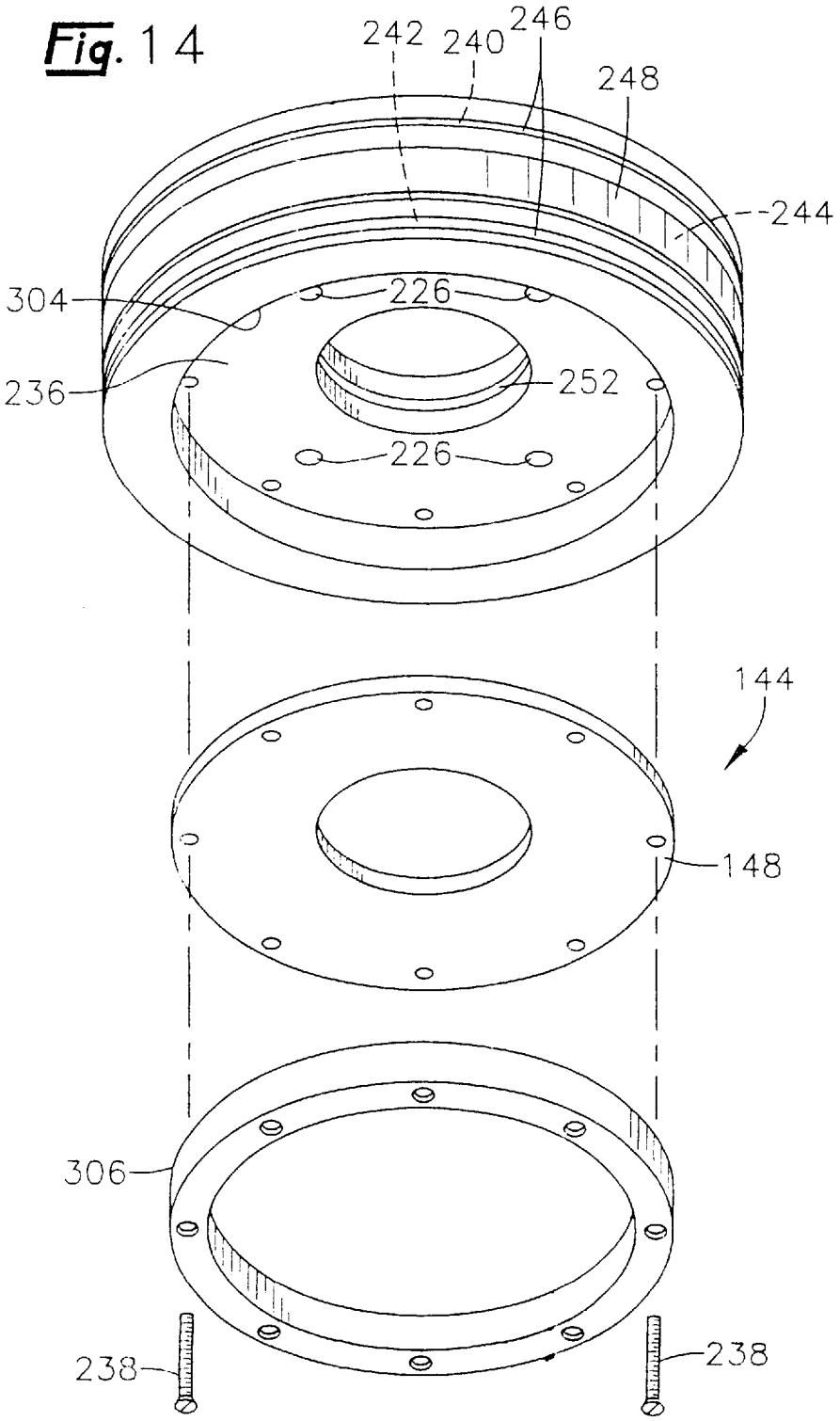
FIG. 14 is an exploded view of a check valve in the piston vibrator.

To further illustrate the parts of the piston vibrator 100, FIGS. 10–13 show sectional views through various elevations of the housing 102. FIG. 10 shows the housing 102, the head of the fluid supply line fitting screw 216 and the head of the back-up cable fitting screw 256. FIG. 11 shows, in order, the housing 102, mount 192, cavity 218, upper valve body 176 having first passageway 220 therethrough, and valve stem 138. FIG. 12 shows, in order, the housing 102, upper biasing spring 152, first longitudinal channels 226 through the upper check valve 144, upper valve body 176 having second passageway 224 therethrough, and valve stem 138. FIG. 13 shows the housing 102, valve body 236, mounting screws 238, first longitudinal channels 226 through the upper check valve 144, and valve stem 138.

Figure 15:
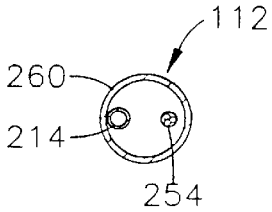
FIG. 15 is a sectional view of a cable connected to the piston vibrator taken along line 15—15 of FIG. 6.

FIG. 15 shows a sectional view of the hollow cable 112, taken along its length. The cable 112 has an outer sheath 260 of PVC-coated braided steel. The fluid supply line 214 and the back-up cable 254 float freely inside the hollow cable 112.

Figure 16:
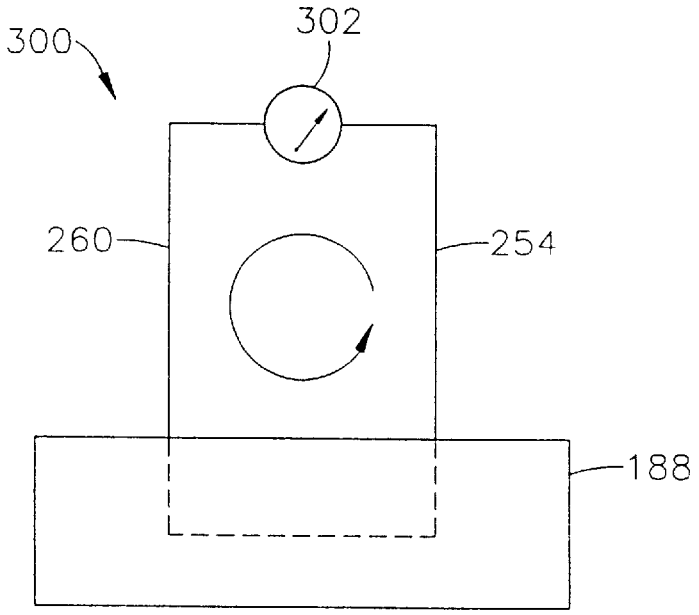
FIG. 16 is a diagrammatic view of a resistance continuity check circuit for monitoring the integrity of the cable.

FIG. 16 shows a diagrammatic view of a resistance continuity check circuit 300 for determining when the cable 112 has been damaged, thereby requiring retraction of the piston vibrator 100 by the back-up cable 254.

As is well-known in the art, an ohmmeter may be used to check continuity in an electrically conductive line. The ohmmeter applies a voltage to the ends of the line and detects current flow therethrough. If no current flows, there is a break in the line. This principle is used to monitor the integrity of the cable 112.

Referring to FIGS. 1 and 16, one lead of an ohmmeter 302 is connected to the braided steel of the cable 112 (i.e., the outer sheath 260 of the cable 112) at or near the cable block associated with the take-up reel 32. The other lead of the ohmmeter is connected to the stainless steel back-up cable 254 at or near the cable block associated with the take-up reel (not shown) of the back-up cable 254. Since the cable 112 and the back-up cable 254 are both fastened to the cable/hose bracket 188 by conductive fittings, and since the cable/hose bracket 188 is constructed of a conductive metal, there will be a complete conductive loop in the circuit 300 when the integrity of the cable 112 is intact. If the cable 112 is severed at any location, a break will appear in the cable's braided steel 260 and the ohmmeter 302 will detect a break in continuity in the loop. The continuity is continuously monitored during use of the piston vibrator 100. If a break is detected, the piston vibrator 100 is turned on (if it not already on) and retracted by the back-up cable 254 while the piston vibrator 100 is operating. If the break is detected early on, the piston vibrator 100 can be retracted before the break becomes sufficiently large to sever the fluid supply hose 214 or the back-up cable 254.

The size and shape of the piston vibrator 100 will vary in accordance with the size of the chute 14, the type of material to be broken up, how fast a jam must be broken up (i.e., a larger vibrator 100 will likely break up the jam faster), and other like factors. One piston vibrator which is suitable for use in a chute 14 of a typical large scale coal-fired plant 10 has the following characteristics and operating parameters:

Longitudinal length of housing: 17 11/32 inches

Outer diameter of housing: 3.0 inches

Mass of piston 128 5.0 lbs.

Piston stroke 2.0 inches

Number of side ports: 4 upper/4 lower

Fluid supply line: 214 3/8 inch air hose into 1/4 inch fitting

Cable 112: 3/4 inch PVC coated hollow braided steel cable

Inlet fluid: air

Inlet fluid pressure: 42 psi. (constant)

Outlet fluid pressure at side ports: 15 psi. (max.)

Piston cycles per minute: 60

Back-up cable 254 3/16 inch stainless steel

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for detecting the presence of and removing jams in a chute used for transporting a flowable material including solids, the chute having an entrance for receiving a flow of the material and an exit, the chute including a jam breaking device located therein for breaking up material jams which occur in the chute, the jam breaking device initially located near the chute exit, and an acoustic detector for detecting acoustic signals associated with movement of the material through the chute, the method comprising the steps of:

(a) periodically detecting an acoustic signal in the chute with the acoustic detector;

(b) processing the acoustic signal to determine whether material is flowing through the chute or whether material is not flowing through the chute due to a jam in the chute, and if a jam is detected;

(c) operating the jam breaking device for a fixed period of time to attempt to break up the jam;

(d) detecting and processing a new acoustic signal after the fixed period of time to determine whether the new acoustic signal indicates that the jam is still present;

(e) moving the jam breaking device a predetermined distance toward the chute entrance; and (f) repeating steps (c), (d) and (e) as long as each new acoustic signal indicates that the jam is still present.

2. A method according to claim 1 wherein the jam breaking device is an air hammer, and wherein step (c) comprises operating the air hammer for the fixed period of time to attempt to break up the jam.

3. A method according to claim 2 wherein the air hammer operates in step (c) by vibrating.

4. A method according to claim 2 wherein the air hammer operates in step (c) by emitting pulses of high pressure air.

5. A method according to claim 2 wherein the air hammer operates in step (c) by vibrating and emitting pulses of high pressure air.

6. A method according to claim 2 wherein the jam breaking device attempts to break up the jam in step (c) by pulverizing the material near the jam breaking device.

7. A method according to claim 1 wherein the chute is generally vertically oriented with the entrance above the exit and the jam breaking device is supported by a line secured to a take-up reel and step (e) includes actuating the take-up reel to move the jam breaking device toward the chute entrance.

8. A method according to claim 7 further comprising the step of:

(g) returning the jam breaking device to be near the chute exit if the acoustic signal detected in step (d) indicates that the jam is no longer present by allowing the flow of the material over and around the jam breaking device to unwind the take-up reel until the jam breaking device reaches the initial location.

9. A method according to claim 1 wherein steps (c) and (e) are performed simultaneously, and wherein during step (d), the jam breaking device is not operating or moving.

10. A method according to claim 9 wherein steps (c) and (e) last about twenty seconds and step (d) lasts less than one second.

11. A method according to claim 1 further comprising the step of:

(g) returning the jam breaking device to be near the chute exit if the acoustic signal detected in step (d) indicates that the jam is no longer present.

12. A method according to claim 1 wherein the fixed period of time is about twenty seconds.

13. A method according to claim 1 wherein step (b) includes the step of detecting the amplitude of the acoustic signal, and comparing the detected signal amplitude to a reference amplitude, a detected signal amplitude near the reference amplitude indicating that the material is flowing through the chute and thus no jam is present, and an amplitude significantly below the reference amplitude indicating that the material is not flowing through the chute and thus a jam is present.

14. A method according to claim 1 wherein step (b) includes the step of comparing the detected acoustic signal to a prestored acoustic signature, a detected acoustic signal similar to the stored acoustic signature indicating that the material is flowing through the chute and thus no jam is present, and an acoustic signature significantly different than the stored acoustic signature indicating that the material is not flowing through the chute and thus a jam is present.

15. A method according to claim 1 further comprising the step of:

(g) monitoring the time from an initial detection of a jam to the present time, and if the time from the initial detection to the present time reaches a preset time period and a jam is still present, (h) outputting a signal indicating that jam removal steps should be terminated.

16. A method according to claim 1 wherein the jam breaking device has a maximum movable distance, the method further comprising the step of:

(g) outputting a signal indicating that the jam cannot be successfully removed if in step (e), the jam breaking device has been moved toward the chute entrance by the maximum movable distance and the jam is still present.

17. An apparatus for detecting the presence of and removing jams in a chute used for transporting a flowable material including solids, the chute having an entrance for receiving a flow of the material and an exit, the apparatus comprising:

(a) an acoustic detector for periodically detecting at least one acoustic signal in the chute;

(b) a processor for receiving and processing the detected acoustic signal by comparing the detected acoustic signal to a prestored acoustic signature, wherein a detected acoustic signal similar to the stored acoustic signature indicates that the material is flowing through the chute and thus no jam is present, and a detected acoustic signature significantly different than the stored acoustic signature indicates that material is not flowing through the chute and thus a jam is present; and (c) a jam breaking device movable between the chute entrance and chute exit for breaking up jams identified by the acoustic processor.

18. An apparatus according to claim 17 further comprising:

(d) a jam breaking device operation and placement controller including (i) a control circuit for operating the jam breaking device for a fixed period of time upon identification by the acoustic processor of a jam, and (ii) a take-up reel for moving the jam breaking device from an initial location near the chute exit toward the chute entrance, the jam breaking device being supported by a line secured to the take-up reel, the take-up reel moving the jam breaking device toward the chute entrance.

19. An apparatus according to claim 18 wherein the jam breaking device operation and placement controller simultaneously operates the jam breaking device and winds the take-up reel for the fixed period of time after identification by the acoustic processor of a jam .

20. An apparatus according to claim 18 wherein the take-up reel is releasable so that flow of the material over and around the jam breaking device moves the jam breaking device toward the chute exit and unwinds the take-up reel until the jam breaking device reaches the initial location.

21. An apparatus according to claim 18 wherein the fixed period of time is about twenty seconds.

22. An apparatus according to claim 18 wherein the jam breaking device is an air hammer and the line includes a hollow braided steel cable and an air supply hose inside the hollow cable, the air supply hose delivering pressurized air to the air hammer.

23. An apparatus according to claim 18 wherein the jam breaking device is tethered to the line.

24. An apparatus according to claim 17 wherein the jam breaking device is an air hammer.

25. An apparatus according to claim 24 wherein the air hammer includes (i) a piston for reciprocating within the air hammer and repeatedly striking a fixed block of mass in the air hammer, thereby causing the air hammer to vibrate, and (ii) at least one air outlet port for expelling a stream of high pressure air created by action of the piston, the vibration and stream of air operating to pulverize material near the air hammer.

26. An apparatus according to claim 17 wherein the acoustic signature includes the signal amplitude, a detected acoustic signal amplitude near the signature amplitude indicating that the material is flowing through the chute and thus no jam is present, and a detected acoustic signal amplitude significantly below the signature amplitude indicating that material is not flowing in the chute and thus a jam is present.

* * * * *